US009062394B2

(12) United States Patent
Jeon et al.

(10) Patent No.: US 9,062,394 B2
(45) **Date of Patent: *Jun. 23, 2015**

(54) POLY(ETHYLENETEREPHTHALATE) TIRE CORD, AND TIRE COMPRISING THE SAME

(75) Inventors: Ok-Hwa Jeon, Gyeongsan-si (KR); Il Chung, Gumi-si (KR); Gi-Woong Kim, Daegu (KR)

(73) Assignee: KOLON INDUSTRIES, INC., Kwacheon (KR)

( * ) Notice: Subject to any disclaimer, the term of this patent is extended or adjusted under 35 U.S.C. 154(b) by 561 days.

This patent is subject to a terminal disclaimer.

(21) Appl. No.: 13/003,737

(22) PCT Filed: Jul. 22, 2009

(86) PCT No.: PCT/KR2009/004069

§ 371 (c)(1),
(2), (4) Date: Jan. 11, 2011

(87) PCT Pub. No.: WO2010/011086

PCT Pub. Date: Jan. 28, 2010

(65) Prior Publication Data

US 2011/0108178 A1 May 12, 2011

Related U.S. Application Data

(60) Provisional application No. 61/083,914, filed on Jul. 26, 2008.

(30) Foreign Application Priority Data

Jul. 22, 2008 (KR) ..... 10-2008-0071074

(51) Int. Cl.
*D02G 3/00* (2006.01)
*D02G 3/48* (2006.01)
*D01F 6/62* (2006.01)

(52) U.S. Cl.
CPC ..... *D02G 3/48* (2013.01); *Y10T 152/10513* (2015.01); *Y10S 57/902* (2013.01); *D01F 6/62* (2013.01); *D10B 2331/04* (2013.01)

(58) Field of Classification Search
CPC ..... B60C 9/0042; D02G 3/48; D01F 6/62; D10B 2331/04; Y10S 57/902; Y10T 152/10513; Y10T 428/29; Y10T 428/2913
USPC ..... 152/451, 527; 428/357, 364, 375, 902
See application file for complete search history.

(56) References Cited

U.S. PATENT DOCUMENTS 3,378,055 A 4/1968 Robertson
3,380,968 A 4/1968 Ridgway et al.

(Continued)

FOREIGN PATENT DOCUMENTS

GB 1 081 452 A 8/1967
GB 1 165 853 A 10/1969

(Continued)

OTHER PUBLICATIONS

Japanese Patent Office, Japanese Office Action issued in corresponding JP Application No. 2011-519991, dated Oct. 22, 2013.

(Continued)

*Primary Examiner* — Jeremy R Pierce
(74) *Attorney, Agent, or Firm* — Sughrue Mion, PLLC

(57) ABSTRACT

Disclosed is a PET tire cord which has a flat spot index (FSI) defined by the following Calculation Formula 1 of 5.0% or less:

$$\text{Flat Spot Index (FSI)}(\%)=(L_1-L_2)/L_0\times 100 \quad \text{Calculation Formula 1}$$

wherein, $L_0$ is an initial length of the tire cord, $L_1$ is a length of the tire cord that is measured after providing a load corresponding to 13% of the strength at break of the cord for 5 minutes at 120° C. and cooling the same to 24° C. while maintaining the load, and $L_2$ is a length of the tire cord that is measured after providing a load corresponding to 13% of the strength at break of the cord for 5 minutes at 120° C. and cooling the same to 24° C. while remaining the load of 0.01 g/d only.

18 Claims, 3 Drawing Sheets

(56) References Cited

U.S. PATENT DOCUMENTS

| | | | | |
|---|---|---|---|---|
| 3,388,029 | A | 6/1968 | Brignac | |
| 3,946,100 | A * | 3/1976 | Davis et al. | 264/211.15 |
| 5,558,935 | A * | 9/1996 | Tanaka et al. | 428/364 |
| 5,894,875 | A * | 4/1999 | Masaki et al. | 152/527 |
| 6,595,256 | B1 * | 7/2003 | Bernstorf et al. | 152/542 |
| 6,764,623 | B2 * | 7/2004 | Kim et al. | 264/103 |
| 2001/0039988 | A1 * | 11/2001 | Kim et al. | 428/364 |
| 2006/0207706 | A1 | 9/2006 | Kwon et al. | |

FOREIGN PATENT DOCUMENTS

| | | | |
|---|---|---|---|
| GB | 1 207 062 | A | 9/1970 |
| JP | 61-019812 | A | 1/1986 |
| JP | 62-069819 | A | 3/1987 |
| JP | 07-070819 | A | 3/1995 |
| JP | 2006-188796 | A | 7/2006 |
| JP | 2007-022366 | A | 2/2007 |
| JP | 2010-530480 | A | 9/2010 |
| JP | 2010-530481 | A | 9/2010 |
| KR | 10-2005-0030774 | A | 3/2005 |
| KR | 10-2005-0051103 | A | 6/2005 |
| KR | 10-2006-0126101 | A | 12/2006 |

OTHER PUBLICATIONS

International Search Report of PCT/KR2009/004069 dated Jun. 15, 2010.

* cited by examiner

POLY(ETHYLENETEREPHTHALATE) TIRE CORD, AND TIRE COMPRISING THE SAME

CROSS REFERENCE TO RELATED APPLICATIONS

This application is a National Stage of International Application No. PCT/KR2009/004069, filed on Jul. 22, 2009, which claims priority from Korean Patent Application No. 10-2008-0071074 filed on Jul. 22, 2008 and U.S. Provisional Application No. 61/083,914 filed Jul. 26, 2008, the contents of all of which are incorporated herein by reference in their entirety.

BACKGROUND OF THE INVENTION (a) Field of the Invention

The present invention relates to a poly(ethyleneterephthalate) (PET) tire cord, and a tire including the same. More particularly, the present invention relates to a PET tire cord that has high dimensional stability, and accordingly can increase riding comfort of a car, and a tire including the same.

(b) Description of the Related Art

Tire is a complex body of fiber/steel/rubber, and generally has a structure as illustrated in FIG. 1. Namely, the steel and the fiber cord take a role of reinforcing the rubber and form a basic skeletal structure in the tire. It is, so to speak, like a role of a bone in a human body.

As a reinforcement of the tire, the performances such as fatigue resistance, shear strength, durability, repelling elasticity, adhesion to a rubber, and the like are required to the cord. Therefore, various cords made of suitable materials are used according to the performances required to the tire.

Recently, rayon, nylon, polyester, steel, aramid, and the like are generally used as the materials for the cord, and the rayon and the polyester are used for a body ply (or a carcass) (6 in FIG. 1), the nylon is mainly used for a cap ply (4 in FIG. 1), and the steel and the aramid are mainly used for a tire-belt part (5 in FIG. 1).

The structure and the characteristics of the tire represented in FIG. 1 are briefly disclosed hereinafter.

Tread 1: A part contacting to the road surface; this part must provide a friction force necessary for braking and driving, be good in abrasion resistance, and also be able to stand against an external shock, and its heat generation must be small.

Body ply (or Carcass) 6: A cord layer inside the tire; this part must support a load and stand against a shock, and its fatigue resistance against bending and stretching movement during a driving must be good.

Belt 5: This part is located between the body plies and mostly composed of steel wire, and it lessens the external shock and also makes the ground-contacting surface of the tread wide and the driving stability good.

Side wall 3: A rubber layer between the lower part of the shoulder 2 and the bead 9; it takes a role of protecting the internal body ply 6.

Bead 9: A square or hexagonal wire bundle, wherein a rubber is coated on the steel wires; it takes a role of fitting and fixing the tire to a rim.

Inner liner 7: A part located inside the tire instead of a tube; it makes a pneumatic tire possible by preventing air leakage.

Cap ply 4: A special cord fabric located on the belt of a radial tire for some passenger cars; it minimizes the movement of the belt during driving.

Apex 8: A triangular rubber packing material used for minimizing the dispersion of the bead, protecting the bead by relieving the external shock, and preventing an air inflow during shaping.

Recently, developments for tires suitable for high-speed driving are required as the passenger cars gentrify, and accordingly the stability during high-speed driving and high durability of the tire are recognized as greatly important characteristics. Furthermore, the performance of the materials for the cap ply cord importantly comes to the force before everything else for satisfying the characteristics. In addition, the performance of the materials for the body ply cord is importantly raised as well, because the body ply inside the tire, that is the carcass, is the kernel of the reinforcement supporting the whole weight of the car and maintaining the shape of the tire.

First, the cap ply cord takes a roll of minimizing the movement of the steel belt in the tire. More particularly, the steel belt inside the tire is generally arranged in the oblique direction, the steel belt, however, tends to move toward the circumferential direction during high-speed driving, and there are some problems that the sharp ends of the steel belt may cause separation between the layers of the belt and shape deformation of the tire by cutting the rubber or generating cracks. The cap ply prevents the separation between the layers and the deformation of the shape of the tire and takes a role of improving the high-speed durability and the driving stability by restraining the movement of the steel belt.

A nylon 66 cord is mainly used for general cap ply cord. The nylon 66 cord may show the effect of restraining the movement of the steel belt by showing high shrinkage force at the stiffening temperature of 180 and wrapping the steel belt, however, a partial deformation may be occurred by the rapid change of temperature inside of the tire during driving and parking the car, or the load of the tire and the car, and it may clatter during driving and deteriorates the riding comfort of the car because of its low modulus and dimensional stability.

Meanwhile, the body ply takes a roll of supporting whole weight of the car and maintaining the shape of the tire. As a cord for the body ply, viscous rayon that is a regenerated fiber or nylon is mainly used, and recently the polyester-based materials is investigated and attempted to apply for the body ply material. Particularly, there are many-sided investigations for using the tire cord composed of the polyester-based materials to the body ply, because it has superior price competitiveness in comparison with the viscous rayon and the like, and can improve durability of the tire as well because of its high strength.

However, the tire cord composed of nylon or polyester-based materials has low dimensional stability against heat in comparison with the tire cord composed of cellulose-based materials, such as viscous rayon, and the like. Therefore, when the nylon or polyester-based tire cord is applied to the body ply, the shape of the tire may largely be deformed, and it becomes very difficult to maintain uniform tire shape. Particularly, the shape of the body ply or the tire may largely be deformed still more by the change of the temperature or the load caused during driving and parking the car, and it may largely affect the performance of the tire, in particular the riding comport of the car.

SUMMARY OF THE INVENTION

An aspect of the present invention is to provide a PET tire cord that is desirably applicable to the cap ply cord, the body ply cord, and the like, and can improve the riding comfort of the car, because of its superior dimensional stability.

Another aspect of the present invention is to provide a pneumatic tire including the tire cord that hardly deforms and can improve the riding comfort of the car.

The present invention provides a PET tire cord of which a Flat Spot Index (FSI) defined by the following Calculation Formula 1 is 5.0% or less:

$$\text{Flat Spot Index (FSI)}(\%)=(L_1-L_2)/L_0\times 100 \quad \text{[Calculation Formula 1]}$$

wherein, $L_0$ is an initial length of the tire cord, $L_1$ is a length of the tire cord that is measured after providing a load corresponding to 13% of the strength at break of the cord for 5 minutes at 120° C. and cooling the same to 24° C. while maintaining the load, and $L_2$ is a length of the tire cord that is measured after providing a load corresponding to 13% of the strength at break of the cord for 5 minutes at 120° C. and cooling the same to 24° C. while remaining the load of 0.01 g/d only.

The present invention also provides a pneumatic tire including the tire cord.

DETAILED DESCRIPTION OF THE EMBODIMENTS

Figure 1:
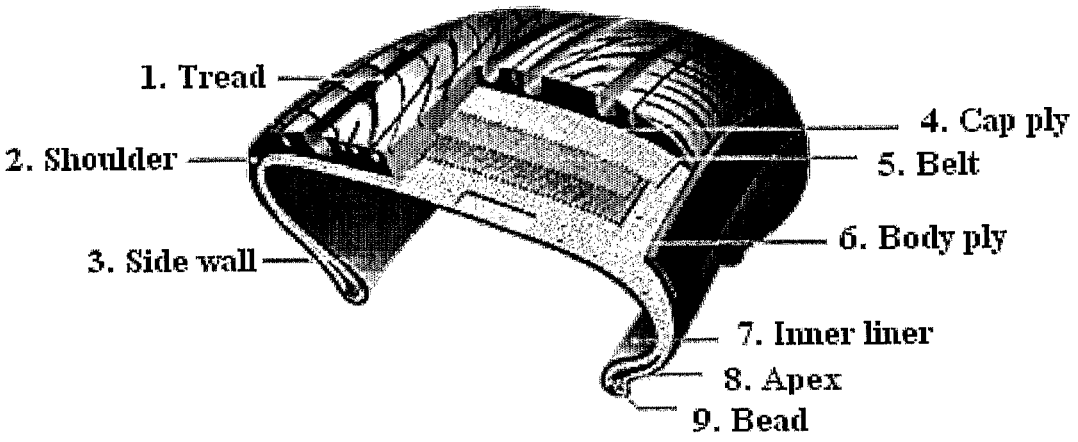
FIG. 1 is a partial cut-away perspective view illustrating a structure of a general tire.

Hereinafter, the PET tire cord, and the tire including the same are explained in more detail according to the specific embodiments of the invention. However, since the embodiments are provided as examples of the invention, the scope of the right of the invention is not limited to or by them and it is obvious to a person skilled in the related art that various modifications of the embodiments are possible within the scope of the right of the invention.

In addition, the term 'include' or 'comprise' means that include any component (or any element) without particular limitations unless otherwise mentioned in the present entire disclosure, and it cannot be interpreted as it excludes the addition of the other components (or elements).

According to one embodiment of the invention, the PET tire cord is provided. The FSI of the PET tire cord defined by the following Calculation Formula 1 is 5.0% or less. More particularly, the FSI of the PET tire cord may be 1.0 to 5.0%, and preferably 2.0 to 4.0%:

$$\text{Flat Spot Index (FSI)}(\%)=(L_1-L_2)/L_0\times 100 \quad \text{[Calculation Formula 1]}$$

wherein, $L_0$ is an initial length of the tire cord, $L_1$ is a length of the tire cord that is measured after providing a load corresponding to 13% of the strength at break of the cord for 5 minutes at 120° C. and cooling the same to 24° C. while maintaining the load, and $L_2$ is a length of the tire cord that is measured after providing a load corresponding to 13% of the strength at break of the cord for 5 minutes at 120° C. and cooling the same to 24° C. while remaining the load of 0.01 g/d only.

Since tire is exposed to the states of high temperature, expansion, and high pressure during driving of a car, with the consequence that the tire cord (for example, cap ply cord or body ply cord) suffers high load, the cord may be deformed. In addition, the tensions of the cord in the part of the tire contacting to the road surface and the cord in the rest part of the tire become different. That is, the cord in the part of the tire contacting to the road surface does not recover from the deformation generated during driving because high load caused by the weight of the car and the tire itself is continuously provided to the part, and the cord in the rest part of the tire recovers from the deformation by withdrawal of the load, and thus there may be difference of the deformation between the tire cords in both parts, as it is called 'flat spot phenomenon'.

By the flat spot phenomenon, the car may clatter when driving after parking, and the riding comfort of the car may be deteriorated.

However, the PET tire cord according to one embodiment of the invention shows the FSI defined by Calculation Formula 1 of 5.0% or less, and it means that the length $L_1$ of the tire cord in the part of the tire contacting to the road surface that did not recover from the deformation generated during driving and the length $L_2$ of the tire cord in the rest part of the tire that recovered from the deformation are not largely different each other after driving and parking the car. Therefore, in the case of using such tire cord, the car does not clatter enough to affect the riding comfort when parking and driving the car again, because the difference between the deformations of the tire cords in both parts is not so much.

On the other hand, when using the tire cord having the FSI over 5.0%, the car may clatter and the riding comfort may be deteriorated due to the flat spot phenomenon disclosed above during driving the car after parking.

Therefore, the tire cord according to one embodiment of the invention can prevent the clattering of the car caused by the flat spot phenomenon and improve the riding comfort because of its superior dimensional stability, and it can preferably be used to the cap ply cord, and the like of the pneumatic tire.

In addition, the tire cord according to one embodiment of the invention shows high dimensional stability as disclosed above, by extension, it shows excellent dimensional stability in comparison with formerly known nylon or other polyester-based tire cords. Particularly, the cord hardly deforms and shows superior dimensional stability even under the state of suffering high load or by the rapid change of heat or the load, as it can be known from that such tire cord shows low FSI. Therefore, the tire cord hardly deforms and can maintain uniform shape of the tire while supporting the whole weight of the car. Therefore, the tire cord according to one embodiment of the invention can desirably be used to the body ply cord, and the like of the pneumatic tire, and show equivalent or superior performance to former viscous rayon used thereto, and it can largely contribute the improvement of performance of the tire and the economical efficiency.

On the other hand, the PET tire cord according to one embodiment of the invention may have the length deformation rate (LDR) defined by the following Calculation Formula 2 of 3.0% or less:

$$\text{Length Deformation Rate (LDR)}(\%)=(L_1-L_0)/L_0\times 100 \quad \text{[Calculation Formula 2]}$$

wherein, $L_0$ is an initial length of the tire cord, and $L_1$ is a length of the tire cord that is measured after providing a load corresponding to 13% of the strength at break of the cord for 5 minutes at 120° C., and cooling the same to 24° C. while maintaining the load.

Such PET tire cord hardly deforms even under the state of high temperature and high load, and maintains superior driving performance of the tire. Particularly, the PET tire cord hardly deforms as it shows the LDR of 3.0% or less even in the case of that the car drives with high-speed after parking and high load is loaded to the tire cord. Therefore, the PET tire cord can secure superior high-speed driving performance of the tire and improve the riding comfort of the car still more because it has superior dimensional stability. Therefore, the PET tire cord can desirably be used to the cap ply cord, and can desirably be used to the body ply cord supporting whole weight of the car and maintaining the shape of the tire, because of its superior dimensional stability disclosed above.

Meanwhile, the shape of the PET tire cord is not specifically limited, and thus it may have equal shape with conventional cap ply cords or body ply cords. More particularly, such PET tire cord may have a shape of a dipped cord, of which the total linear density per cord is 1000 to 5000 denier (d), the number of ply is 1 to 3, and the twisting level is 200 to 500 TPM (twist per meter), according to the shape of conventional cap ply cords or body ply cords.

Furthermore, the tire cord may have strength of 5 to 8 g/d and preferably 5.5 to 7 g/d, elongation at the load 4.5 kgf of 1.5 to 5.0% and preferably 2.0 to 3.5%, and elongation at break of 10 to 25% and preferably 15 to 25%. The tire cord can desirably be applied to the cap ply cord or the body ply cord, according as it shows the properties, such as the strength, the elongation, and the like, of the above range.

Furthermore, the tire cord may be applied to the pneumatic tire as the cap ply cord and the like. When the tire cord is used to the cap ply cord, the tire in which the PET tire cord is included can prevent clattering of the car due to the deformation of the cap ply cord and the tire, because the cap ply cord has superior dimensional stability and hardly deforms even if the driving speed of the car is changed and the load loaded to the cap ply cord is largely changed. Therefore, the tire can improve the controllability or the riding comfort of the car still more. Furthermore, since the PET tire cord has several properties, such as the strength, the elongation, and the like, those are suitable as the cap ply cord, the tire in which the cap ply cord is included can show stable high-speed driving performance.

Furthermore, the tire cord also can be applied to the body ply cord desirably as it shows superior dimensional stability disclosed above. The tire including the tire cord as body ply cord hardly deforms and can maintain uniform shape of the tire while supporting the whole weight of the car stably, even under rapid change of heat or load during drive. Furthermore, since the properties, such as the strength, the elongation, and the like, of the tire cord are superior as well, the tire including such body ply cord can show superior performance and economical efficiency.

Simply, the PET tire cord according to one embodiment of the invention disclosed above is mainly explained by supposing that the cord is used as the cap ply cord or the body ply cord, however, the use of the PET tire cord is not limited to this and it is of course that the cord may be used for the other uses such as other tire cords, rubber belts, and the like.

Meanwhile, the PET tire cord may be prepared by the method of melt-spinning the PET so as to prepare an undrawn PET fiber, drawing the undrawn PET fiber so as to prepare a drawn PET fiber, and twisting the drawn PET fibers and dipping the same in an adhesive, and it may be a dipped cord. At this time, The PET tire cord having above mentioned properties can be prepared under the specific conditions or the specific proceeding methods of each step, that are directly or indirectly reflected to the properties of the prepared tire cord.

Particularly, it is revealed that the PET tire cord according to one embodiment of the invention of which the FSI is very low and the dimensional stability is good can be prepared by controlling the conditions of melt-spinning the PET so as to prepare the undrawn PET fiber having crystallinity of 25% or more and an amorphous orientation factor (AOF) of 0.15 or less, preparing the drawn PET fiber by using the same under predetermined drawing conditions, and using the same.

Basically, PET has partially crystallized structure and is composed of crystalline regions and amorphous regions. However, the degree of crystallization of the undrawn PET fiber obtained under the controlled melt-spinning conditions is higher than that of the former known drawn PET fiber because of the oriented crystallization phenomenon, and the crystallinity is 25% or more, and preferably 25 to 40%. The drawn PET fiber and the tire cord prepared from the undrawn PET fiber can show high modulus due to such high crystallinity.

At the same time, the undrawn PET fiber shows the AOF of 0.15 or less, and preferably 0.08 to 0.15, which is largely lower than that of former known undrawn PET fiber. The AOF means that the degree of orientation of the chains included in the amorphous region of the undrawn fiber, and it has low value as the entanglement of the chains of the amorphous region increases. Generally, the drawn fiber and the tire cord prepared from the undrawn fiber having the low AOF value show the advantage of low shrinkage rate and the disadvantage of low shrinkage force at the same time, because the degree of disorder increases as the AOF decreases and the chains of the amorphous region becomes not a strained structure but a relaxed structure. However, the undrawn PET fiber obtained under the controlled melt-spinning conditions includes more cross-linking bonds per a unit volume, because the molecular chains constituting the undrawn PET fiber slip during the spinning process and form a fine network structure. On this account, the undrawn PET fiber may become the structure of which the chains of the amorphous region are strained in spite of the largely lower AOF value, and thus it shows developed crystalline structure and superior orientation characteristics due to this.

Therefore, it becomes possible to prepare the drawn PET fiber and the tire cord having high shrinkage force and modulus together as well as low shrinkage rate by using the undrawn PET fiber showing such high crystallinity and low AOF. Moreover, it is possible to provide the PET tire cord showing the properties (for example, low FSI, and the like) according to one embodiment of the invention and having superior dimensional stability and modulus according to this.

Hereinafter, the preparing method of the PET tire cord is explained step-by-step more in detail, as follows.

In the preparing method of the tire cord, firstly, the undrawn PET fiber having high crystallinity and low AOF disclosed above is prepared by melt-spinning the PET.

At this time, the melt-spinning process may be carried out with a higher spinning stress in order to obtain the undrawn PET fiber satisfying such crystallinity and AOF. For example, the melt-spinning process may be carried out with the spinning stress of 0.85 g/d or more, and preferably 0.85 to 1.25 g/d. Also, for example, the melt-spinning speed of the PET may be controlled to be 3800 to 5000 m/min, and preferably 4000 to 4500 m/min.

As results of experiments, it is revealed that the crystallinity increases as the oriented crystallization phenomenon occurs, and the undrawn PET fiber satisfying the crystallinity and the AOF disclosed above can be obtained as the molecular chains constituting the PET slip during the spinning process and form a fine network structure, according as the melt-spinning process of the PET is carried out with the high spinning stress and selectively high spinning speed. However, it is realistically not easy to control the spinning speed to be over 5000 m/min and it is also difficult to carry out the cooling process because of the excessive spinning speed.

Furthermore, the chips having an intrinsic viscosity of 0.8 to 1.3 and including 90 mol % or more of PET may be used in the melt-spinning as the PET in the preparing process of the undrawn PET fiber.

As disclosed above, it is possible to give the conditions of higher spinning speed and spinning stress to the preparing process of the undrawn PET fiber, and it is preferable that the intrinsic viscosity is 0.8 or more in order to carry out the spinning step preferably with the conditions. Also, it is preferable that the intrinsic viscosity is 1.3 or less in order to prevent the scission of the molecular chains due to the increase of the melting temperature of the chips and the increase of the pressure due to the extrusion amount in the spinning pack.

Furthermore, it is preferable that the chips are spun through the spinnerets designed for making linear density of a monofilament to be 2.0 to 4.0 denier, and preferably 2.5 to 3.0 denier. Namely, it is preferable that the linear density of the monofilament must be 2.0 denier or more in order to lessen the possibility of the fiber scission during the spinning and the fiber scission due to the interference of the fibers during the cooling, and it is also preferable that the linear density of the monofilament is 4.0 denier or less in order to give the sufficient spinning stress by raising the spinning draft.

Furthermore, the undrawn fiber may be prepared by adding the cooling process after the melt-spinning of the PET. Such cooling process may preferably be carried 15 out according to the method of providing a cooling air of 15 to 60° C., and the cooling air flow may preferably be controlled to be 0.4 to 1.5 m/s in each temperature condition of the cooling air. With this, it is possible to prepare the tire cord showing several properties according to one embodiment of the invention more easily.

On the other hand, the drawn fiber is prepared by drawing the undrawn fiber after preparing the undrawn PET fiber satisfying the crystallinity and the AOF disclosed above through the spinning step. At this time, the drawing process may be carried out under the condition of a drawing ratio of 0.1 to 1.55. In the undrawn PET, the crystalline region is developed, and the chains of the amorphous region also have low degree of orientation and form the fine network. Therefore, the scission of the fibers or hairiness may occur in the drawn fiber when the drawing process is carried out with the drawing ratio of over 1.55, and thus the drawn PET fiber prepared by the method is also hard to show the preferable properties. Furthermore, the strength of the tire cord prepared therefrom may partially be lowered when the drawing process is carried out with a relatively low drawing ratio. However, it is possible to prepare the PET tire cord having superior strength suitable to be applied to the cap ply cord, the body ply cord, and the like, for example, under the drawing ratio of 1.0 or more, and thus the drawing process may preferably be carried out with the drawing ratio of 1.0 to 1.55.

Furthermore, it is possible to heat-treat the undrawn fiber at the temperature of about 160° C. or more and less than 240° C., and preferably 200° C. or less in order to carry out the drawing step preferably, in the drawing step.

After preparing the drawn fiber, the dipped cord is prepared by twisting the drawn fibers and dipping the same into the adhesive, wherein the twisting process and the dipping process follow the conditions and the conventional methods of preparing PET tire cord.

The PET tire cord prepared like this may have total linear density of 1000 to 5000 denier, number of ply of 1 to 3, and twisting level of 200 to 500 TPM, and may also show superior properties disclosed above, for example, less FSI, low LDR, superior dimensional stability, and so on.

Meanwhile, the pneumatic tire including the PET tire cord disclosed above is provided according to another embodiment of the invention. More particularly, such pneumatic tire may include the PET tire cord as the cap ply cord or the body ply cord, and the rest elements except the same follow the elements of common pneumatic tire.

Such tire has superior dimensional stability while supporting whole weight of the car stably, and can show superior high-speed driving performance and improve the riding comfort of the car, because it includes the tire cord, for example the cap ply cord or the body ply cord, that hardly deforms even in rapid change of speed and load.

EXAMPLES

Hereinafter, the technical features and the operations of invention are described in further detail through preferable examples. However, the following examples are only for the understanding of the invention and the invention is not limited to or by them.

Example 1

A PET polymer of which the intrinsic viscosity was 1.05 was used, and the undrawn PET fiber was prepared by melt-spinning the PET polymer under the spinning stress of 1.15 g/d and the spinning speed of 4500 m/min, and cooling the same, according to conventional preparing method. And then, the drawn PET fiber was prepared by drawing the undrawn fiber with the drawing ratio of 1.24, and heat-setting and winding the same.

The PET tire cord of Example 1 was prepared by Z-twisting (counter-clockwise twisting) the drawn PET fibers of which the total linear density was 1000 denier with the twisting level of 430 TPM, S twisting (clockwise twisting) 2 plies of the Z twisted fibers with the same twisting level, dipping and passing the same through an resorcinol/formaldehyde/latex (RFL) adhesive solution, and drying and heat-treating the same.

The composition of the RFL adhesive solution and the conditions of the drying and the heat-setting process followed the conventional conditions for treating PET cord.

Examples 2-6

The drawn PET fibers were prepared substantially according to the same method as in Example 1, except that the conditions of the spinning speed, the spinning stress, the drawing ratio, or the intrinsic viscosity was changed in the preparing method of the drawn PET fiber as disclosed in the following Table 1, and the PET tire cords of Examples 2-6 were prepared by twisting, dipping, drying, and heat-treating substantially according to the same method as in Example 1.

TABLE 1

| Conditions | Example 2 | Example 3 | Example 4 | Example 5 | Example 6 |
|---|---|---|---|---|---|
| Spinning Speed (m/min) | 4000 | Same to Example 1 | Same to Example 1 | 3800 | 4800 |
| Spinning Stress (g/d) | 0.92 | 0.98 | 1.23 | 0.86 | 1.19 |
| Drawing Ratio | 1.46 | Same to Example 1 | Same to Example 1 | 1.54 | 1.16 |
| Intrinsic Viscosity | Same to Example 1 | 0.9 | 1.2 | Same to Example 1 | Same to Example 1 |

the crystallinity was calculated by using the following calculation formula:

$$PET\ \text{Crystallinity}\ (\%) = Xc(\%) = \left(\frac{\rho - \rho_a}{\rho_c - \rho_a}\right) \times 100$$

wherein, $\rho_a$=1.336, and $\rho_c$=1.457 in case of the PET.

Amorphous orientation factor (AOF): the AOF was calculated according to the following formula by using the birefringence index measured by using a polarized micrometer and the crystal orientation factor (COF) measured by X-ray diffraction (XRD):

AOF=(birefringence index−crystallinity (%)*0.01*COF*0.275)/((1−crystallinity (%)*0.01)*0.22).

TABLE 2

| | Example 1 | Example 2 | Example 3 | Example 4 | Example 5 | Example 6 | Comparative Example 1 | Comparative Example 2 |
|---|---|---|---|---|---|---|---|---|
| Crystallinity (%) | 36 | 30 | 34 | 36 | 28 | 38 | 2 | 9 |
| AOF | 0.009 | 0.093 | 0.015 | 0.012 | 0.120 | 0.002 | 0.005 | 0.245 |

Comparative Example 1

Preparation of the Tire Cord by Using a High Modulus Low Shrinkage (HMLS) Fiber The PET tire cord of Comparative Example 1 was prepared substantially according to the same method as in Example 1, except that the undrawn fiber was prepared by melt-spinning the PET polymer of which the intrinsic viscosity was 1.05 under the spinning stress of 0.52 g/d and the spinning speed of 3000 m/min, and the drawn fiber was prepared by drawing the undrawn fiber with the drawing ratio of 1.8.

Comparative Example 2

Preparation of the Tire Cord by Using a Nylon 66 Fiber

The undrawn fiber was prepared by melt-spinning the nylon 66 polymer of which the relative viscosity was 3.3 with the spinning speed of 600 m/min and cooling, and then the drawn fiber using the nylon 66 fiber was prepared by drawing the undrawn fiber with the drawing ratio of 5.5, and heat-setting and winding the same.

The tire cord of Comparative Example 2 using the nylon 66 fiber was prepared by Z-twisting the drawn fibers of which the total linear density was 840 denier with the twisting level of 310 TPM, S twisting 2 plies of the Z twisted fibers with the same twisting level, dipping and passing the same through the RFL adhesive solution, and drying and heat-treating the same.

The composition of the RFL adhesive solution and the conditions of the drying and the heat-setting process followed the conventional conditions for treating nylon 66 cord.

First, the crystallinity and the AOF of the undrawn fibers obtained in Examples 1 to 6 and Comparative Examples 1 and 2 were measured according to the following methods, and the measured results are listed in the following Table 2:

Crystallinity: the density was measured after preparing a density gradient tube by using $CCl_4$ and n-heptane, and Referring Table 2, it is recognized that the undrawn fibers of Examples 1 to 6 prepared under the high spinning stress and spinning speed have high crystallinity and low AOF, and show developed crystalline structure and superior orientation characteristic, however, the undrawn fibers of Comparative Examples 1 and 2 do not satisfy such characteristics on the contrary.

Subsequently, the change of the length ($L_1$) of the cord after changing the state from high temperature and high load to low temperature and high load and the change of the length ($L_2$) of the cord after changing the state from high temperature and high load to low temperature and low load were measured with regard to the tire cords prepared in Examples 1 to 6 and Comparative Examples 2 and 3. The change of the length was measured by using a shrinkage behavior tester (Testright Co., MK-V), based on the testing method of shrinkage rate of ASTM D 4974.

More concretely, the initial length ($L_0$) of the tire cord specimen used to the test was 270 mm.

Furthermore, the state of high temperature and high load was supposed to the condition of temperature and load those are given to the tire cord during driving, and the load corresponding to 13% of the strength at break was continuously given to the tire cord for 5 minutes at 120° C.

And, the state of low temperature and high load (measuring condition of $L_1$) was supposed to the condition of temperature and load those are given to the tire cord in the part of the tire contacting to the road surface, and the state was continued for 3 minutes after cooling the tire cord specimen to 24° C. while maintaining the high load.

Furthermore, the state of low temperature and low load (measuring condition of $L_2$) was supposed to the condition of temperature and load those are given to the tire cord in the rest part of the tire except the part contacting to the road surface, and the state was continued for 3 minutes after cooling the tire cord specimen to 24° C. and reducing the load to 0.01 g/d.

Figure 2:
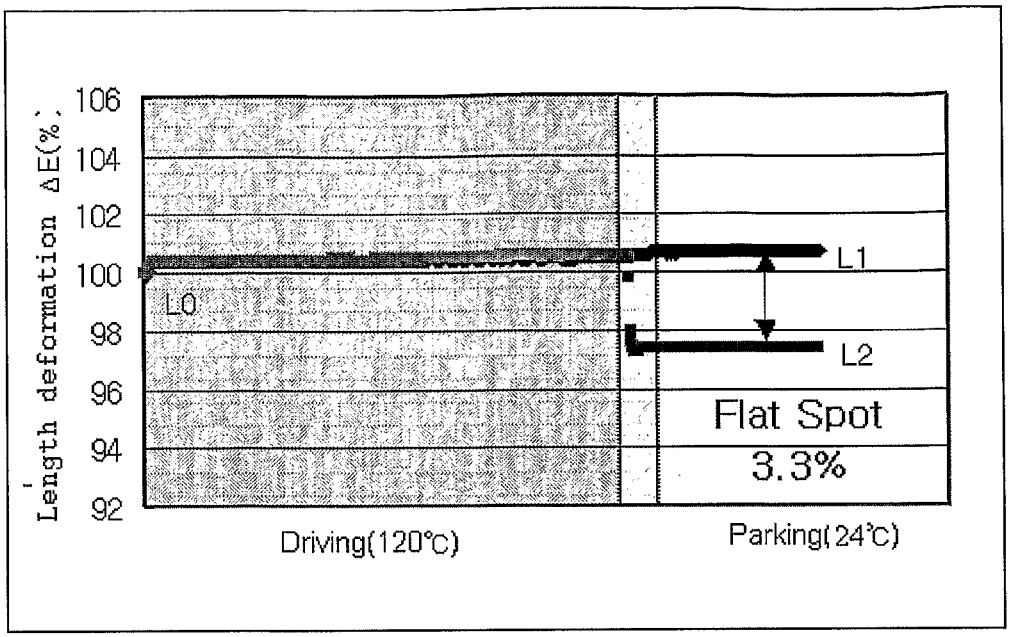
FIG. 2 is a graph showing the length deformation and the Flat Spot Index (FSI) of the tire cord prepared by Example 1 according to change of temperature and load.
Figure 3:
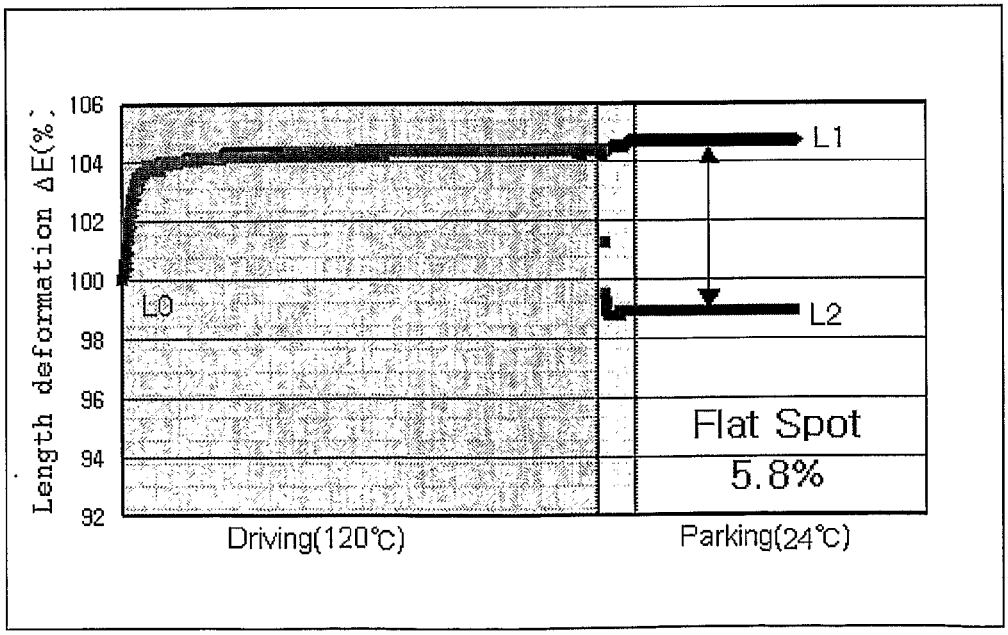
FIGS. 3 and 4 are graphs showing the length deformation and the Flat Spot Index (FSI) of the tire cord prepared by Comparative Examples 1 and 2 according to change of temperature and load.
Figure 4:
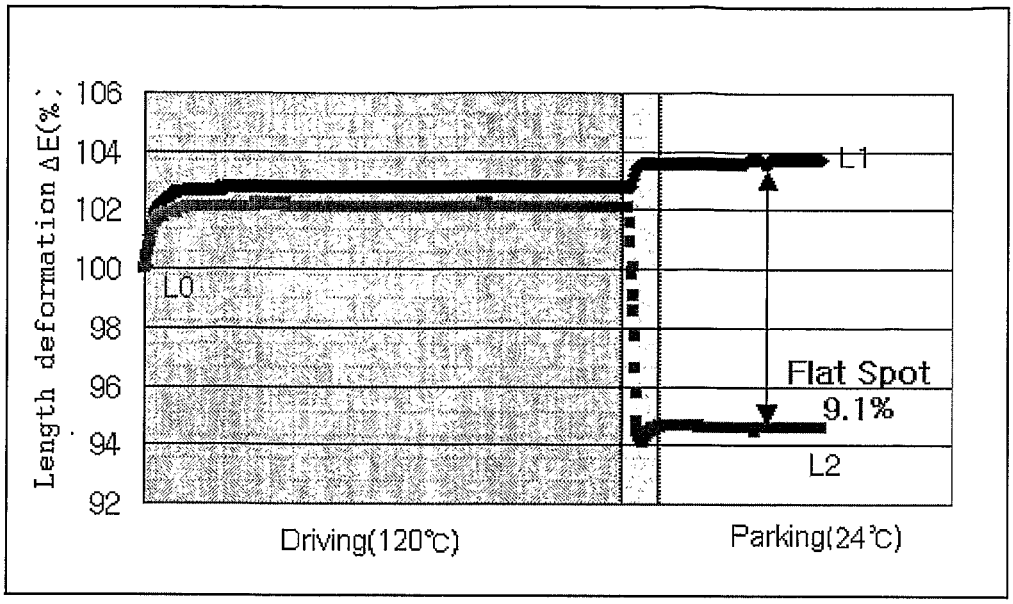

The graphs of the length deformation measured with regard to the tire cords of Example 1 and Comparative Examples 1 and 2 are illustrated in FIGS. 2 to 4, and the FSI and the LDR measured with regard to the tire cords of Examples 1 to 6, and Comparative Examples 1 and 2 are listed in the following Table 3.

TABLE 3

| | FSI (%) | LDR (%) ΔE | $L_0$ (mm) | $L_1$ (mm) | $L_2$ (mm) |
|---|---|---|---|---|---|
| Example 1 | 3.3 | 0.70 | 270 | 271.89 | 262.98 |
| Example 2 | 3.5 | 0.75 | 270 | 272.02 | 262.57 |
| Example 3 | 3.6 | 0.87 | 270 | 272.34 | 262.62 |
| Example 4 | 2.8 | 0.35 | 270 | 270.94 | 263.38 |
| Example 5 | 4.0 | 1.00 | 270 | 272.71 | 261.91 |
| Example 6 | 2.5 | 0.17 | 270 | 270.46 | 263.71 |
| Comparative Example 1 | 5.8 | 4.70 | 270 | 282.69 | 267.03 |
| Comparative Example 2 | 9.1 | 3.70 | 270 | 280.00 | 255.46 |

Referring Table 3 and FIGS. 2 to 4, it is recognized that the tire cords of Examples 1 to 6 show very low FSI and LDR in comparison with the tire cord of Comparative Example 1 composed of the other conventional PET fibers (HMLS fibers) or the tire cord of Comparative Example 2 composed of nylon 66 fibers.

From this, it is recognized that the tire cords of Examples 1 to 6 hardly deform and show superior dimensional stability in comparison with the tire cords composed of the other PET fibers or nylon 66 fibers. Particularly, when the car parks after driving, the tire cords of Examples 1 to 6 do not show large difference between the length $L_1$ at the ground-contacting part where the deformation generated during driving is not recovered and the length $L_2$ at the rest part where the deformation is recovered.

Consequently, it is recognized that the tire cords of Examples 1 to 6 have high dimensional stability and can largely improve the riding comfort of the car by preventing clattering of the car caused by the flat spot phenomenon.

What is claimed is:

1. A poly(ethylene terephthalate) (PET) tire cord, of which a flat spot index (FSI) defined by the following Calculation Formula 1 is 5.0% or less, $$\text{Flat Spot Index (FSI)}(\%)=(L_1-L_2)/L_0\times 100 \qquad \text{Calculation Formula 1}$$

wherein, $L_0$ is an initial length of the tire cord, $L_1$ is a length of the tire cord that is measured after providing a load corresponding to 13% of the strength at break of the cord for 5 minutes at 120° C. and cooling the same to 24° C. while maintaining the load, and $L_2$ is a length of the tire cord that is measured after providing a load corresponding to 13% of the strength at break of the cord for 5 minutes at 120° C. and cooling the same to 24° C. while remaining the load of 0.01 g/d only, wherein the PET tire cord comprises a drawn PET fiber prepared by drawing an undrawn PET fiber at a draw ratio of 0.1-1.55, wherein the undrawn PET fiber has a crystallinity of 25 to 40% and an amorphous orientation factor (AOF) of 0.15 or less.

2. The PET tire cord according to claim 1, wherein the FSI is 2.0 to 4.0%.

3. The PET tire cord according to claim 1, of which a length deformation rate (LDR) defined by the following Calculation Formula 2 is 3.0% or less:

$$\text{Length Deformation Rate (LDR)}(\%)=(L_1-L_0)/L_0\times 100 \qquad \text{Calculation Formula 2}$$

wherein, $L_0$ is an initial length of the tire cord, and $L_1$ is a length of the tire cord that is measured after providing a load corresponding to 13% of the strength at break of the cord for 5 minutes at 120° C. and cooling the same to 24° C. while maintaining the load.

4. The PET tire cord according to claim 1, having strength of 5 to 8 g/d, elongation at the load 4.5 kgf of 1.5 to 5.0%, and elongation at break of 10 to 25%.

5. The PET tire cord according to claim 1, having total linear density of 1000 to 5000 denier, number of ply of 1 to 3, and twisting level of 200 to 500 TPM.

6. The PET tire cord according to claim 1, wherein the tire cord is a cap ply cord or a body ply cord.

7. A pneumatic tire including the tire cord according to claim 1.

8. The pneumatic tire according to claim 7, wherein the tire cord is applied to a cap ply or a body ply.

9. The PET tire cord according to claim 2, wherein the tire cord is a cap ply cord or a body ply cord.

10. The PET tire cord according to claim 3, wherein the tire cord is a cap ply cord or a body ply cord.

11. The PET tire cord according to claim 4, wherein the tire cord is a cap ply cord or a body ply cord.

12. The PET tire cord according to claim 5, wherein the tire cord is a cap ply cord or a body ply cord.

13. A pneumatic tire including the tire cord according to claim 2.

14. A pneumatic tire including the tire cord according to claim 3.

15. A pneumatic tire including the tire cord according to claim 4.

16. A pneumatic tire including the tire cord according to claim 5.

17. A poly(ethylene terephthalate) (PET) tire cord, of which a flat spot index (FSI) defined by the following Calculation Formula 1 is 5.0% or less, $$\text{Flat Spot Index (FSI)}(\%)=(L_1-L_2)/L_0\times 100 \qquad \text{Calculation Formula 1}$$

wherein, $L_0$ is an initial length of the tire cord, $L_1$ is a length of the tire cord that is measured after providing a load corresponding to 13% of the strength at break of the cord for 5 minutes at 120° C. and cooling the same to 24° C. while maintaining the load, and $L_2$ is a length of the tire cord that is measured after providing a load corresponding to 13% of the strength at break of the cord for 5 minutes at 120° C. and cooling the same to 24° C. while remaining the load of 0.01 g/d only, wherein the PET tire cord comprises a drawn PET fiber prepared by drawing an undrawn PET fiber at a draw ratio of 0.1-1.24, wherein the undrawn PET fiber has a crystallinity of 25 to 40% and an amorphous orientation factor (AOF) of 0.15 or less.

18. A poly(ethylene terephthalate) (PET) tire cord, of which a flat spot index (FSI) defined by the following Calculation Formula 1 is 5.0% or less, $$\text{Flat Spot Index (FSI)}(\%)=(L_1-L_2)/L_0\times 100 \qquad \text{Calculation Formula 1}$$

wherein, $L_0$ is an initial length of the tire cord, $L_1$ is a length of the tire cord that is measured after providing a load corresponding to 13% of the strength at break of the cord for 5 minutes at 120° C. and cooling the same to 24° C. while maintaining the load, and $L_2$ is a length of the tire cord that is measured after providing a load corresponding to 13% of the strength at break of the cord for 5 minutes at 120° C. and cooling the same to 24° C. while remaining the load of 0.01 g/d only, wherein the PET tire cord comprises a drawn PET fiber prepared by drawing an undrawn PET fiber at a draw ratio of 0.1-1.55, wherein the undrawn PET fiber has a crystallinity of 25 to 40% and an amorphous orientation factor (AOF) of 0.15 or less, and wherein the undrawn PET fiber is prepared under conditions comprising a spinning stress of 0.85-1.25 g/d and a spinning speed at 3800-5000 m/min.

* * * * *